US005522947A

United States Patent [19]

Kogiku et al.

[11] Patent Number: 5,522,947

[45] Date of Patent: Jun. 4, 1996

[54] AMORPHOUS IRON BASED ALLOY AND METHOD OF MANUFACTURE

[75] Inventors: Fumio Kogiku; Masao Yukumoto; Seiji Okabe, all of Chiba, Japan

[73] Assignee: Kawasaki Steel Corporation, Japan

[21] Appl. No.: 427,428

[22] Filed: Apr. 24, 1995

Related U.S. Application Data

[62] Division of Ser. No. 343,728, Nov. 22, 1994, Pat. No. 5,466,304.

[51] Int. Cl.[6] ..... H01F 1/153

[52] U.S. Cl. ..... 148/304; 148/307; 420/117; 420/121

[58] Field of Search ..... 148/304, 403, 148/307; 420/121, 117

[56] References Cited

U.S. PATENT DOCUMENTS

| | | | |
|---|---|---|---|
| 4,587,507 | 6/1986 | Takayama et al. | 148/403 |
| 4,637,843 | 1/1987 | Takayama et al. | 420/117 |

FOREIGN PATENT DOCUMENTS

| | | | |
|---|---|---|---|
| 57-193005 | 11/1982 | Japan | 148/304 |
| 57-193006 | 11/1982 | Japan | 148/304 |

*Primary Examiner*—John Sheehan
*Attorney, Agent, or Firm*—Austin R. Miller

[57] ABSTRACT

Disclosed are an amorphous iron based alloy having excellent magnetic characteristics as well as bendability and a method of manufacturing the amorphous iron based alloy.

The amorphous iron based alloy has a mean centerline Ra surface roughness of about 0.8 μm or less and the formula $Fe_XB_YSi_ZMn_a$ in approximate proportions wherein:

75<X<82 at %

7<Y<15 at %,

7<Z<17 at %, and 0.2<a<0.5 at %.

The method of manufacturing the amorphous iron based alloy comprises quenching and solidifying a molten alloy having the formula $Fe_XB_YSi_ZMn_a$ in approximate proportions wherein:

75<X<82 at %

7<Y<15 at %,

7<Z<17 at %, and 0.2<a<0.5 at %, and effecting the quenching and solidifying steps in a $Co_2$. atmosphere containing $H_2$ in an amount of about 1–4% by volume.

2 Claims, 5 Drawing Sheets

AMORPHOUS IRON BASED ALLOY AND METHOD OF MANUFACTURE

This is a division of Ser. No. 343,728, filed Nov. 22, 1994, now U.S. Pat. No. 5,466,304.

BACKGROUND OF THE INVENTION

1. Field of the Invention

The present invention relates to an amorphous iron based alloy having excellent magnetic characteristics as well as resistance to brittleness. The invention further relates to a method of manufacturing the amorphous iron based alloy.

2. Description of the Related Art

As disclosed in Japanese Patent Unexamined Publications No. 54-148122 (1979), No. 55-9460 (1980) and No.57-137451 (1982), when a molten alloy composed of Fe-BS-i or the like is ejected onto the surface of a cooling roll rotating at high speed, using the single roll method or the like, and is quenched and solidified at a cooling speed of about $10^{5°}$–$10^{6°}$ C./sec., a so-called amorphous alloy sheet can be produced with a thickness of about several dozens of microns and wherein the atoms are disposed in a disorderly arrangement.

Such an amorphous alloy sheet has low iron loss and high magnetic flux density and has excellent so-called soft magnetic characteristics when attempted to be put into practical use as a core material of a transformer.

Nevertheless, such a sheet composed of the Fe-B-Si ternary amorphous alloy has disadvantages. Although the sheet can achieve an iron loss value which is low to some degree, the improvement of iron loss is limited. A further reduced iron loss cannot be expected from a ternary alloy. To cope with this problem, attempts have been made to add various elements to the ternary amorphous alloy as a fourth component.

For example, Japanese Patent Examined Publication No. 1-54422 (1989) proposed an amorphous iron based alloy obtained by the addition of Mn, Ni and the like to an Fe-BS-i alloy in an amount of 0.5–3 at % (atomic percent) and the thus obtained amorphous iron based alloy had a low iron loss and excellent insulating film processing properties. However, when Mn is added in an amount of 0.5 at % or more, the material becomes brittle. Further, reduction of magnetic flux density becomes a problem in practical use.

Japanese Patent Unexamined Publication No. 62-192560 (1987) proposed an amorphous alloy obtained by adding one element or two or more selected from Cr, Mo, Ta, Mn, Ni, Co, V, Nb and W to a Fe-B-Si alloy, in an amount of 0.05–5 at %, and further subjecting the resulting alloy to a process such as rolling or the like for adjustment of surface roughness of the alloy.

However, Japanese Patent Unexamined Publication No. 62-192560 (1987) does not take brittleness into consideration. Further, even if the surface roughness of the alloy made into a sheet is adjusted by rolling or the like, such a process is doubtfully effective for reduction of brittleness. In addition, adjustment of surface roughness is industrially very ineffective and also disadvantageous as to manufacturing cost.

The present invention is directed to overcoming the aforesaid problems advantageously, and relates to an amorphous iron based alloy having excellent magnetic characteristics as well as resistance to brittleness. It is further directed to a method of manufacturing such a superior amorphous iron based alloy.

SUMMARY OF THE INVENTION

To improve the iron loss of an Fe-B-Si amorphous iron based alloy, it is effective in some ways to add a slight amount of Mn to the alloy, as described above. However, this is disadvantageous because it is accompanied by reduction of magnetic flux density and increase of brittleness of the material.

As a result of a zealous examination for overcoming the above disadvantage, the inventors have obtained the following knowledge:

(1) when a Mn content is 0.2 at % or more to less than 0.5 at %, iron loss can improved without so much reducing magnetic flux density;

(2) when molten alloy is quenched and solidified in a reducing atmosphere, in particular, in a $CO_2$ atmosphere containing a small amount of $H_2$, the surface roughness of the sheet is greatly improved as compared with molten alloy quenched and solidified in the atmosphere and thus the cooling speed of the alloy is increased as well as the oxidized state of the sheet surface is also improved, and as result, cracks are difficult to be produced and material can be effectively ductile;

(3) when the surface roughness is improved, since a demagnetizing field due to magnetic poles which is caused by irregular surface is reduced, magnetic flux density is improved; and (4) when the surface property of the sheet is improved by effecting a quenching and solidifying process in the ($H_2$+$CO_2$) atmosphere, the disadvantage such as the reduction of magnetic flux density and/or the embrittlement which are caused by the addition of Mn can be completely overcome.

More specifically, the present invention relates to an amorphous iron based alloy having excellent magnetic characteristics as well as resistance to brittleness, and is composed of a component represented by the following chemical formula and having a surface roughness of about 0.8 μm or less in terms of a mean roughness along the centerline Ra. The formula is $Fe_XB_YSi_ZMn_a$, where about $75<X<82$ at %

$7<Y<15$ at %

$7<Z<17$ at %

$0.2<a<0.5$ at %.

The amorphous iron based alloy can effectively be bent in intimate contact in a critical bending test.

Further, the present invention relates to a method of manufacturing an amorphous iron based alloy having excellent magnetic characteristics as well as resistance to brittleness, comprising the step of quenching and solidifying a molten alloy composed of a component represented by the following chemical formula, wherein the quenching and solidifying process is effected in a $CO_2$ atmosphere containing $H_2$ in an amount of about 1–4% by volume.

The formula is $Fe_XB_YSi_ZMn_a$, where about $75<X<82$ at %

$7<Y<15$ at %

$7<Z<17$ at %

$0.2<a<0.5$ at %.

BRIEF DESCRIPTION OF THE DRAWINGS

Results of actual test work giving examples how the present invention is achieved will be described below, and in the drawings, wherein:

FIG. 1 shows a result of actual tests on the relationship between amount of Mn and iron loss W13/50 (iron loss value when the frequency was 50 Hz and the magnetic flux density was 1.3T) of an amorphous iron based alloy composed of $Fe_{78-a}B_{13}Si_9Mn_a$.

The molten alloy was quenched and solidified in air, in air and $Co_2$, and in a $CO_2$ atmosphere containing $H_2$ up to 4%. The resulting amorphous iron based alloy was 25 μm thick and 20 mm wide and was annealed at 400° C. for one hour in a magnetic field. The resulting samples were investigated.

Figure 2:
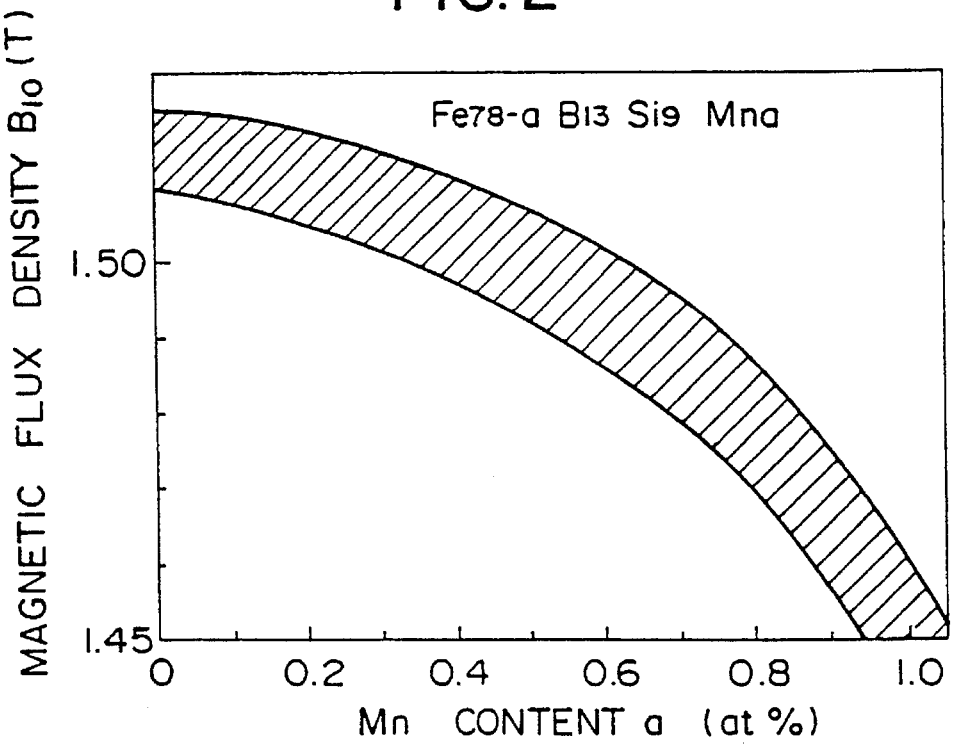
FIG. 2 is a chart showing determined relationships between magnetic flux density $B_{10}$ and Mn content in an amorphous iron based alloy composed of $Fe_{78-a}B_{13}Si_9Mn_a$.

FIG. 2 shows results of tests on the relationship between Mn content and magnetic flux density $B_{10}$ (magnetic flux density in a magnetic field of 1000 A/m) of an amorphous iron based alloy having the same components. The band-shaped dispersion of the magnetic flux density to the Mn content in FIG. 2 is caused by dispersion of surface roughness of the samples.

Figure 1:
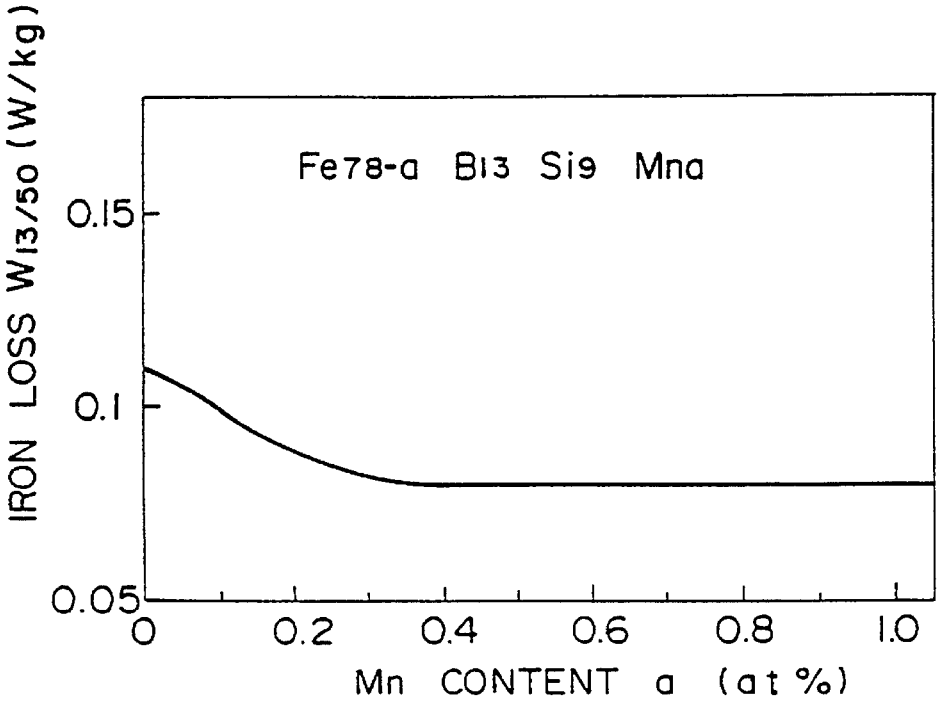
FIG. 1 is a chart showing determined relationships between iron loss $W_{13/50}$ and Mn content in an amorphous iron based alloy composed of $Fe_{78-a}B_{13}Si_9Mn_a$.

It is found from FIGS. 1 and 2 that a low iron loss can be obtained and the reduction of a magnetic flux density can be also suppressed by the addition of a small amount of Mn to Fe-B-Si ternary alloy.

Figure 3:
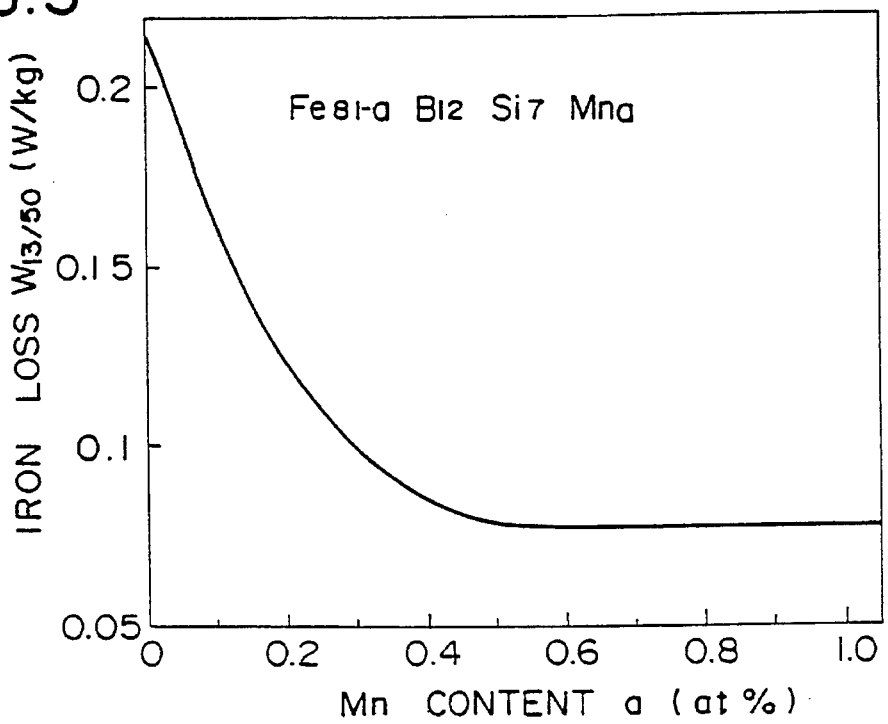
FIG. 3 is a chart showing determined relationships between iron loss $W_{13/50}$ and Mn contents in an amorphous iron based alloy composed of $Fe_{81-a}B_{12}Si_7Mn_a$.
Figure 4:
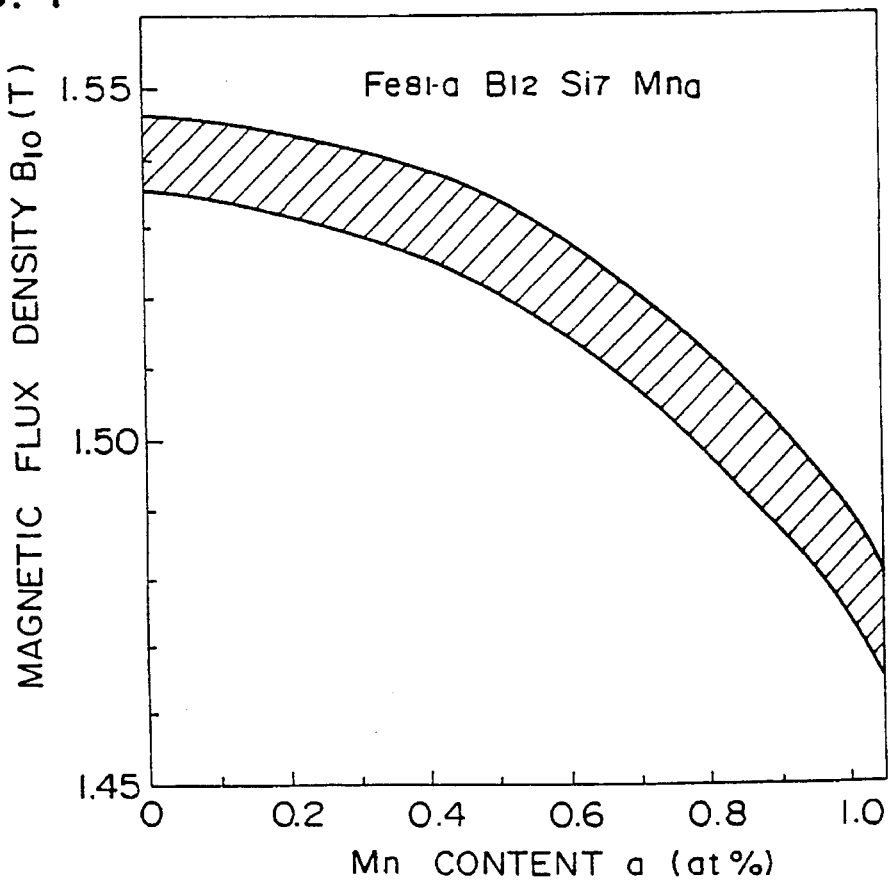
FIG. 4 is a chart showing determined relationships between magnetic flux density $B_{10}$ and Mn contents in an amorphous iron based alloy composed of $Fe_{81-a}B_{12}Si_7Mn_a$.

FIGS. 3 and 4 show the relationship between Mn content and iron loss $W_{13/50}$ and the relationship between Mn content and magnetic flux density $B_{10}$ of an amorphous iron based alloy composed of $Fe_{81-a}B_{12}Si_7Mn_a$, respectively in the same way as in FIGS. 1 and 2.

A sheet made of an amorphous iron based alloy composed of $Fe_{81-a}B_{12}Si_7Mn_a$ was annealed at 360° C. for one hour in a magnetic field. The band-shaped dispersion of the magnetic flux density to the Mn content in FIG. 4 is caused by dispersion of surface roughness of the samples.

As apparent from FIGS. 3 and 4, a low iron loss can be obtained and the reduction of a magnetic flux density can be also suppressed by the addition of a small amount of Mn also in this case.

Further, in particular, when a large amount of Fe exceeding 80% is contained as the case of this alloy composition, there is also an advantage that the effect of reducing an iron loss resulting from the addition of Mn is more remarkably increased.

Figure 5:
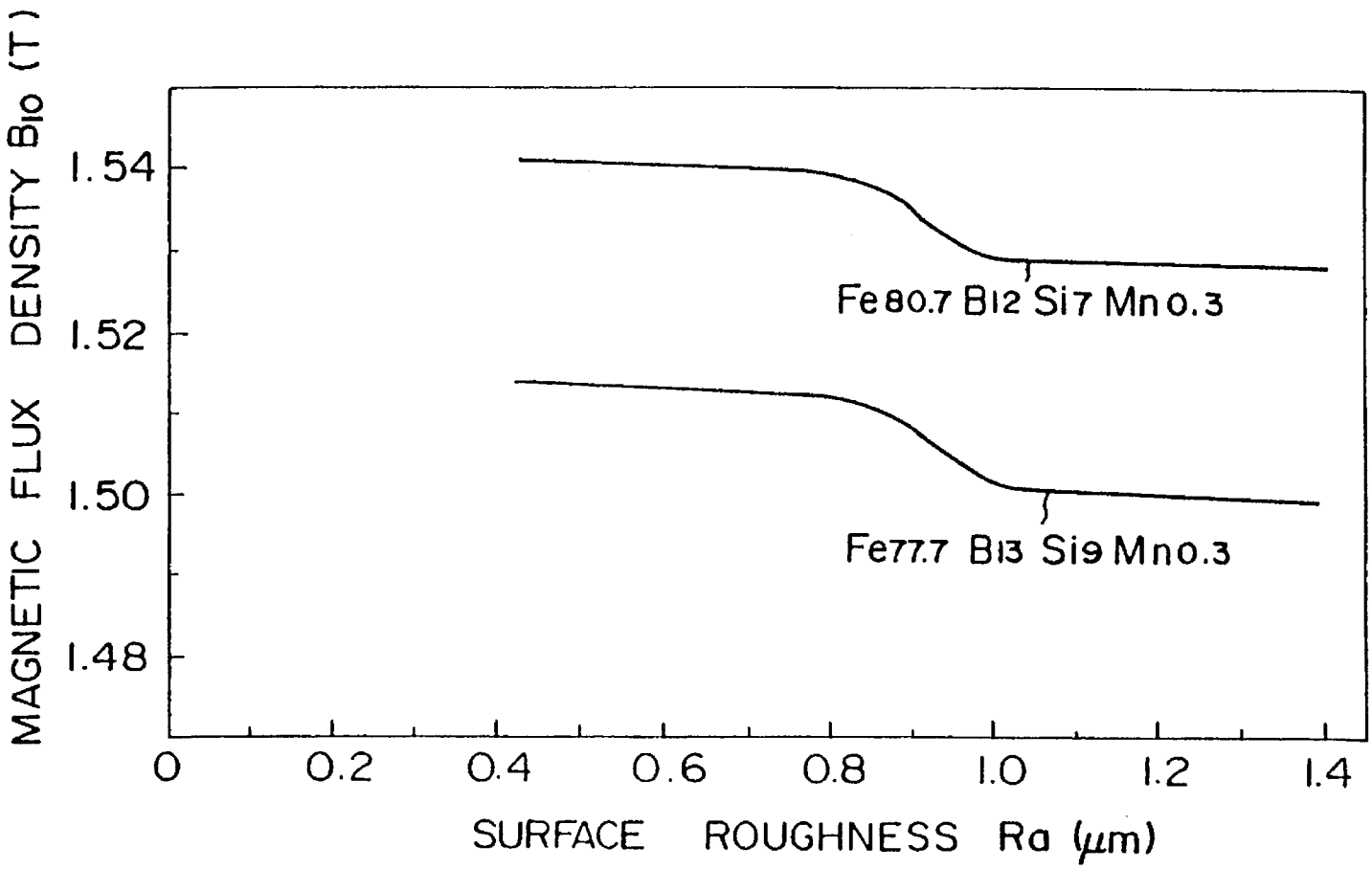
FIG. 5 is a chart showing determined relationships between magnetic flux density $B_{10}$ and mean centerline roughness Ra both in an amorphous iron based alloy composed of $Fe_{80.7}B_{12}Si_7Mn_{0.3}$ and in an amorphous iron based alloy composed of $Fe_{77.7}B_{13}Si_9Mn_{0.3}$.

FIG. 5 shows the relationship between mean roughness along the centerline Ra and magnetic flux density when a is controlled to be 0.3 at % in the amorphous iron based alloys composed of $Fe_{78-a}B_{13}Si_9Mn_a$ and $Fe_{81-a}B_{12}Si_7Mn_a$ .

The Ra is an average value obtained by measuring the surface contacted to a quench roll three times at the center part of the sheet in a sheet width direction according to JIS B0601.

It is shown in FIG. 5 that when the average roughness on the centerline Ra is reduced, the magnetic flux density can be greatly improved.

Figure 6:
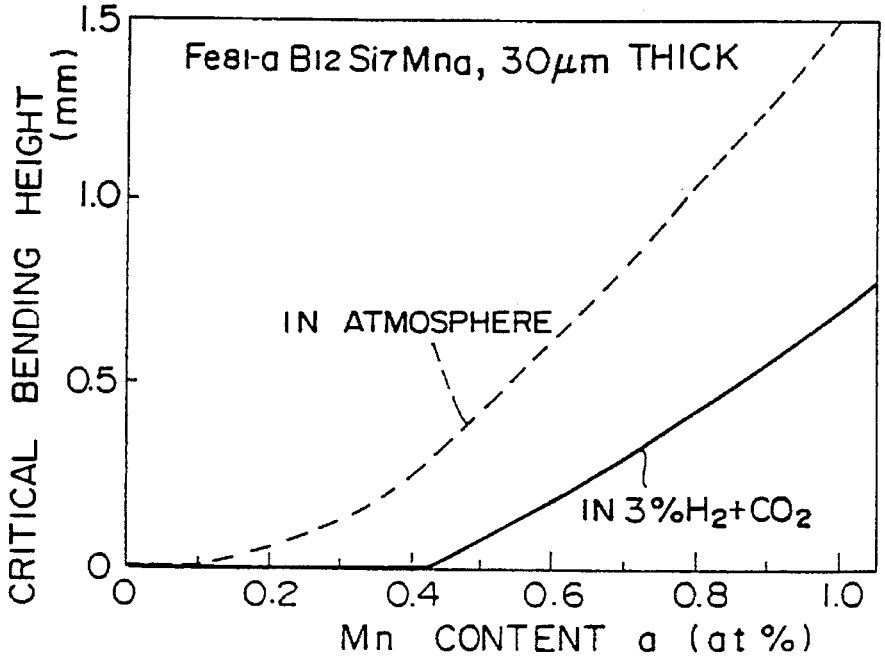
FIG. 6 is a chart showing relation between an amount of Mn content and the bending limit heights in an various atmosphere at the time of rapid solidification of an amorphous iron based alloy with a sheet thickness of 30 μm composed of $Fe_{81-a}B_{12}Si_7Mn_a$.

When an amorphous iron based alloy with a sheet thickness of 30 μm composed of $Fe_{81-a}B_{12}Si_7Mn_a$ was quenched and solidified in air, the bending limit height was increased as the Mn content was increased as shown by the dotted line in FIG. 6.

The bending limit height is an index for indicating degree of brittleness of a material. It is represented by the distance between the inner surfaces of a sheet 150 mm long just before the sheet is broken when it is being bent with the surface thereof in contact with a roll directed to the outside. When the bending limit height is 0, the sheet can be bent upon itself in intimate contact.

On the other hand, when the same amorphous iron based alloy was quenched and solidified in a $CO_2$ atmosphere containing 3% $H_2$, the resulting bending limit height of the alloy was greatly reduced. This is shown by the solid line of FIG. 6.

Figure 7:
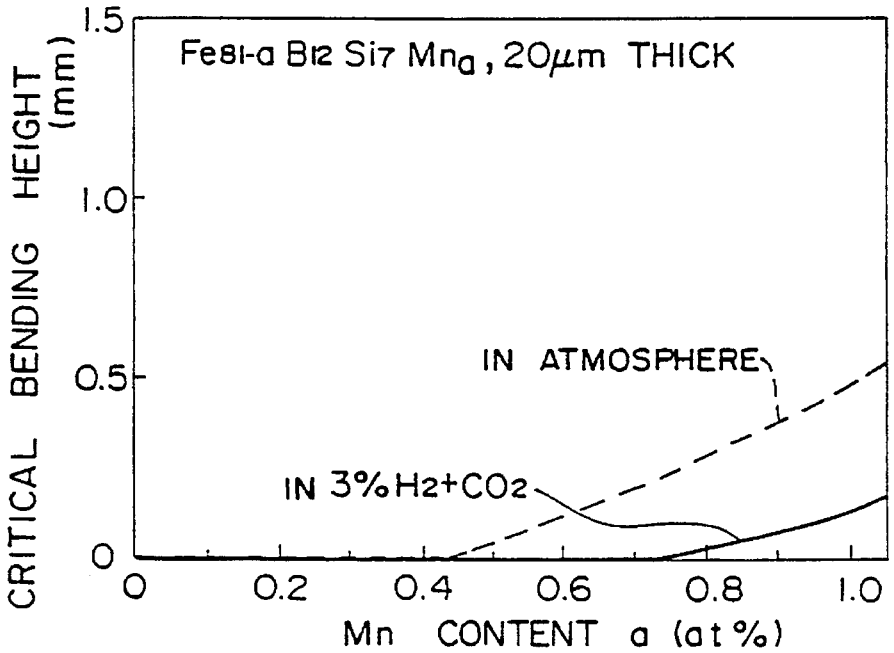
FIG. 7 is a chart showing relation between an amount of Mn content and the bending limit heights in an various atmosphere at the time of rapid solidification of an amorphous iron based alloy with a sheet thickness of 20 μm composed of $Fe_{81-a}B_{12}Si_7Mn_a$ .

Further, FIG. 7 shows the case that a sheet having the same composition, is 20 μm thick in the same way. When the molten alloy was quenched and solidified in the $CO_2$ atmosphere containing 3% $H_2$ in the same way as FIG. 6, it is found that the bending limit height of the amorphous alloy is reduced and brittleness is improved.

A difference of characteristics of the sheet may be caused by a difference of the atmosphere in which the sheet is processed. This affects the condition of the surface of the sheet. We have found that when the sheet was made in air, the sheet had a surface roughness of about 0.8–1.2 μm, expressed as Ra, on the surface of the sheet in contact with a roll, whereas when the sheet was made in a $CO_2$ atmosphere containing 3% $H_2$, the sheet had a surface roughness of about 0.4–0.8 μm and less irregularity.

Figure 8:
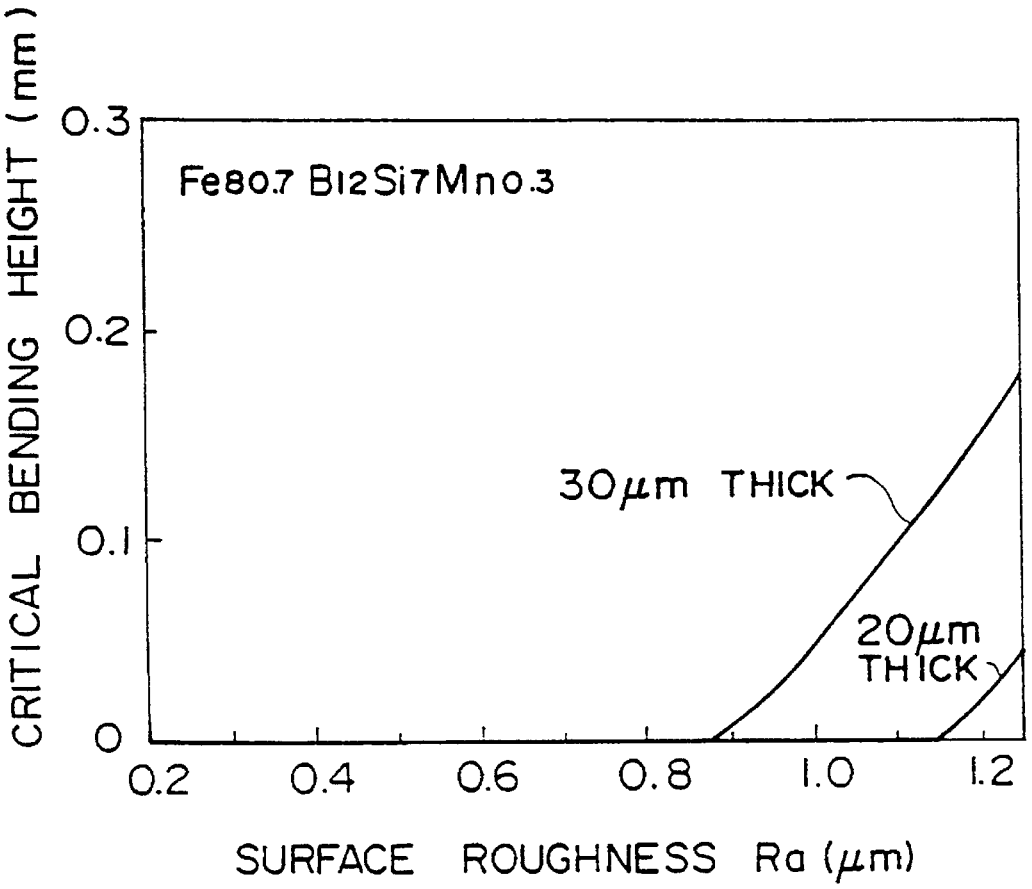
FIG. 8 is a chart showing relation between a mean roughness Ra and the bending limit heights of at different sheet thicknesses each in an amorphous iron based alloy composed of $Fe_{80.7}B_{12}Si_7Mn_{0.3}$.

FIG. 8 shows the relationship between Ra and brittleness. It can be found that when the Ra is reduced, the sheet become less brittle. The number of irregular portions from which cracks start, when the sheet is bent, is very small and the sheet is difficult to be cracked accordingly.

Further, when the Ra is reduced, since heat is effectively transmitted from the alloy to a cooling roll when the alloy is quenched and solidified, a cooling speed is increased so that the alloy reaches the ideal amorphous state.

Further, a reason why the $CO_2$+$H_2$ atmosphere is effective to the improvement of brittleness is that an effect of improving the oxidized state of sheet surface is also obtained by the reducing atmosphere, in addition to the effect of improving the Ra.

Next, reasons why the components of the novel alloy are limited to the above ranges will be described below.

Fe: about 75–82 at % (hereinafter, atomic percentages are simply shown as %)

Fe is an important element for determining magnetic properties. When the Fe content is less than about 75%, the magnetic flux density of the alloy is too low, whereas when the Fe content exceeds about 82%, iron loss is increased and thermal stability deteriorates. Thus, the Fe content is limited to a range of about 75–82%. A more preferable range is about 80 to 82%.

B: about 7–15%

Although B is useful to make the material amorphous, when B is less than about 7%, it is difficult to make the material amorphous, whereas when the B content exceeds about 15%, magnetic flux density is reduced and the Curie temperature is also reduced. Thus, the B content is limited to a range of about 7–15%. A more preferable range of the content is about 9–13%.

Si: about 7–17%

Although Si promotes making the material amorphous and achieves thermal stability, when the Si content is less than about 7%, the Curie temperature is low and not practically usable, whereas when the Si content exceeds about 17%, iron loss is increased. Thus, the Si content is limited to a range of about 7–17%. A more preferable range of the content is about 7–10%.

Mn: about 0.2% or more to less than about 0.5%

Although Mn is effective to reduce iron loss, when Mn is less than about 0.2%, there is little effect upon iron loss. When the Mn content is about 0.5% or more, magnetic flux density is reduced as the Mn content is increased and the material becomes more brittle. Thus, the Mn content is limited to a range of from about 0.2% or more to less than about 0.5%.

When a material is quenched and solidified in air, the material becomes more brittle as shown in FIGS. 6 and 7. When, for example, a transformer winding is made, difficulties such as breaking of the sheet are likely to be caused by the brittleness of the material.

The bending limit height should be as small as possible to prevent these difficulties. A sheet that is capable of being bent upon itself in intimate contact is most effective.

When a material can be bent in intimate contact, no breaking of the sheet is caused when winding a transformer. More specifically, when the bending limit height is about 0.10 mm, this defect occurs at a rate of 0.2%, whereas when the bending limit height is about 0.25 mm, defects occur at a rate of 0.8%.

Thus, the present invention effectively controls and limits the brittleness of a material by keeping its surface roughness to about 0.8 μm or less (Ra) as well as reducing the oxidation of the surface of a sheet by effecting quenching and solidifying in a $CO_2$ atmosphere containing $H_2$ in a range of about 1–4%.

The atmosphere used in quenching and solidification is mainly composed of $CO_2$ because the gas is inactive and available at low cost and has a high radiation capability because it is a ternary gas and has a high specific gravity. Thus, the gas effectively acts to reduce surface roughness by entrapment of the gas.

It is important to maintain the $H_2$ gas content of the $CO_2$ gas to a range of about 1–4%. When the $H_2$ gas content is less than about 1%, surface roughness (Ra) cannot be kept to about 0.8 μm or less. Also the reduction of surface oxidation is not sufficient because a sufficient reducing atmosphere cannot be obtained. In sharp distinction, when the $H_2$ gas content exceeds about 4%, the handling of the gas becomes a serious problem because there is danger of explosion. Further, when the $H_2$ gas content is further increased the gas invades the sheet surface and makes the sheet brittle.

DETAILED DESCRIPTION OF PREFERRED EMBODIMENT

EXAMPLE 1

Molten alloys containing Fe in an amount exceeding 80 at % and various components shown in Table 1 were injected onto the surface of a Cu roll rotating at high speed in a vessel of a $CO_2$ atmosphere containing 3% $H_2$ and made to amorphous alloy sheets of 25 μm thick and 20 mm wide and then the sheets were annealed at 340°–420° C. for an hour in a magnetic field.

Annealing in a magnetic field is a well-known method of annealing a sheet while a magnetic field is applied to the sheet in a direction toward which the sheet is desired to be magnetized so that the soft magnetic properties of the sheet are improved.

Table 1 shows the result of measurements of iron loss values, magnetic flux density and surface roughness of the surface in contact with the roll of the resulting amorphous iron based alloy sheets.

As is apparent from Table 1, the amorphous alloy sheets obtained by the present invention had low iron losses and magnetic flux densities excellently adapted to be used for transformers.

Further, the sheets could easily be bent upon themselves in intimate contact in critical bending tests, and had excellent resistance to brittleness.

Whereas, although the comparative examples could be subjected to an intimate contact bending, all of them had high iron loss or low magnetic flux density.

TABLE 1

| Sample No. | Composition (at %) | $W_{13/50}$ (W/kg) | $B_{10}$ (T) | Surface Roughness Ra (μm) | Critical Bending Height (mm) | Reference |
|---|---|---|---|---|---|---|
| 1 | $Fe_{81.6}B_{11}Si_7Mn_{0.4}$ | 0.109 | 1.550 | 0.7 | intimate bending possible | Example of the Present invention |
| 2 | $Fe_{81.55}B_{11}Si_8Mn_{0.45}$ | 0.087 | 1.546 | 0.8 | " | " |
| 3 | $Fe_{81.7}B_{10}Si_{8\ Mn0.3}$ | 0.104 | 1.547 | 0.6 | " | " |
| 4 | $Fe_{81.6}B_{10}Si_8Mn_{0.4}$ | 0.091 | 1.542 | 0.7 | " | " |
| 5 | $Fe_{80.8}B_{12}Si_7Mn_{0.2}$ | 0.095 | 1.538 | 0.6 | " | " |
| 6 | $Fe_{80.6}B_{12}Si_7Mn_{0.4}$ | 0.084 | 1.530 | 0.7 | " | " |
| 7 | $Fe_{81.0}B_{12}Si_7$ | 0.213 | 1.545 | 0.7 | " | Comparative Example |
| 8 | $Fe_{81.9}B_{11}Mn_{0.1}$ | 0.162 | 1.540 | 0.7 | " | " |
| 9 | $Fe_{80.3}B_{12}Si_7Mn_{0.7}$ | 0.082 | 1.515 | 0.7 | " | " |
| 10 | $Fe_{80.1}B_{12}Si_7Mn_{0.9}$ | 0.081 | 1.493 | 0.7 | " | " |

EXAMPLE 2

Molten alloys containing Fe in an amount 80 at % or less and various components shown in Table 2 were evaluated in the same way as the embodiment 1 and the result of the evaluation is shown in Table 2.

As apparent from Table 2, all of the amorphous alloy sheets obtained according to the present invention had low iron loss and excellent bendability.

Whereas, the comparative examples had high iron loss or low magnetic flux density although they could be subjected to intimate contact bending.

According to the present invention, the iron loss of an Fe-B-Si amorphous iron based alloy can be reduced and its magnetic flux density can be increased.

Further, according to the present invention, the brittleness of a material after addition of Mn can be effectively reduced and sheet breakage in manufacture of winding transformers can be prevented by effecting the quenching and solidifying process in a $CO_2$ atmosphere containing a slight amount of $H_2$.

TABLE 2

| Sample No. | Composition (at %) | $W_{13/50}$ (W/kg) | $B_{10}$ (T) | Surface Roughness Ra (μm) | Critical Bending Height (mm) | Reference |
|---|---|---|---|---|---|---|
| 11 | $Fe_{77.8}B_{13}Si_9Mn_{0.2}$ | 0.089 | 1.515 | 0.6 | initimate bending possible | Example of the Present invention |
| 12 | $Fe_{77.7}B_{13}Si_{9\ Mn0.3}$ | 0.082 | 1.512 | 0.7 | " | " |
| 13 | $Fe_{77.6}B_{13}Si_9Mn_{0.4}$ | 0.080 | 1.508 | 0.7 | " | " |
| 14 | $Fe_{77.55}B_{13}Si_9Mn_{0.45}$ | 0.080 | 1.505 | 0.7 | " | " |
| 15 | $Fe_{77.65}B_{13}Si_9Mn_{0.35}$ | 0.080 | 1.510 | 0.8 | " | " |
| 16 | $Fe_{79.7}B_{12}Si_8Mn_{0.3}$ | 0.098 | 1.520 | 0.7 | " | " |
| 17 | $Fe_{79.6}B_{12}Si_8Mn_{0.4}$ | 0.091 | 1.518 | 0.7 | " | " |
| 18 | $Fe_{76.7}B_9Si_{14}Mn_{0.3}$ | 0.092 | 1.493 | 0.6 | " | " |
| 19 | $Fe_{76.6}B_9Si_{14}Mn_{0.4}$ | 0.090 | 1.490 | 0.7 | " | " |
| 20 | $Fe_{78}B_{13}Si_9$ | 0.115 | 1.520 | 0.6 | " | Comparative Example |
| 21 | $Fe_{77.9}B_{13}Si_{9\ Mn0.1}$ | 0.113 | 1.511 | 0.7 | " | " |
| 22 | $Fe_{80}B_{12}Si_8$ | 0.231 | 1.535 | 0.6 | " | " |
| 23 | $Fe_{77}B_9Si_{14}$ | 0.203 | 1.495 | 0.7 | " | " |
| 24 | $Fe_{77.2}B_{13}Si_9Mn_{0.8}$ | 0.080 | 1.463 | 0.6 | " | " |

EXAMPLE 3

Amorphous iron alloy sheets each composed of $Fe_{80.6}B_{12}Si_7Mn_{0.4}$ (thickness: 30 μm) were made by the same method as Example 1 except that the atmospheres used in quenching and solidification were variously changed as shown in Table 3.

TABLE 3

| Sample No. | Atmosphere in Quenching and Solidification | $W_{13/50}$ (W/kg) | $B_{10}$ (T) | Ra (μm) | Critical Bending Height | Reference |
|---|---|---|---|---|---|---|
| 25 | Air | 0.085 | 1.524 | 1.2 | 0.25 | Comparative Example |
| 26 | $CO_2$ | 0.085 | 1.529 | 0.9 | 0.13 | Comparative Example |
| 27 | 0.5% $H_2$ + $CO_2$ | 0.084 | 1.530 | 0.9 | 0.10 | Comparative Example |
| 28 | 10% $H_2$ + $CO_2$ | 0.084 | 1.536 | 0.7 | 0.05 | Comparative Example |
| 29 | 1.0% $H_2$ + $CO_2$ | 0.084 | 1.537 | 0.7 | intimate contact bending achieved | Example of the Present Invention |
| 30 | 4.0% $H_2$ + $CO_2$ | 0.084 | 1.537 | 0.7 | intimate contact bending achieved | Example of the Present Invention |
| 31 | 60% $CO_2$ + Air | 0.085 | 1.525 | 1.1 | 0.20 | Comparative Example |
| 32 | 80% $CO_2$ + Air | 0.085 | 1.525 | 1.0 | 0.16 | Comparative Example |

Surface roughnesses of the surfaces in contact with the roll and bending limit heights of each of the thus obtained sheets were investigated. Table 3 shows the results of the investigation, together with iron loss and magnetic flux density.

As is apparent from Table 3, the surface roughnesses and the bending limit heights of the sheets were changed depending upon differences of the atmospheres used in quenching and solidification. When the sheets were made in atmospheres according to the present invention, the sheets had small mean roughnesses along centerlines Ra of 0.7 μm and had excellent resistance to brittleness more than sufficient to enable intimate contact bending.

When an atmosphere contained $H_2$ in an amount less than 1%, all of the mean centerline Ra surface roughnesses exceeded 0.8 μm, and further, as the Ra increased, the limit bending height increased and brittleness proceeded.

Further, when an excessive amount of $H_2$ was contained (Sample No. 28), although the Ra was 0.7 μm, intimate contact bending could not be effected.

What is claimed is:

1. An amorphous iron based alloy having excellent magnetic characteristics as well as bendability, and having a mean centerline Ra surface roughness of about 0.8 μm or less, said alloy having the formula $Fe_XB_YSi_ZMn_a$ in approximate proportions wherein:

$75<X<82$ at %, $7<Y<15$ at %, $7<Z<17$ at %, and $0.2<a<0.5$ at %.

2. An amorphous iron based alloy according to claim 1, which can be bent upon itself in intimate contact in a critical bending test.

* * * * *

UNITED STATES PATENT AND TRADEMARK OFFICE

CERTIFICATE OF CORRECTION

PATENT NO. : 5,522,947

DATED : June 4, 1996

INVENTOR(S) : Fumio Kogiku, Masao Yukumoto and Seiji Okabe

It is certified that error appears in the above-indentified patent and that said Letters Patent is hereby corrected as shown below:

On title page, at [57] ABSTRACT, line 7, please change "75<X<82" to --75≤X≤82--;
line 8, please change "7<Y<15" to --7≤Y≤15--;
line 9, please change "7<Z<17" to --7≤Z≤17--;
line 10, please change "0.2<a<0.5" to --0.2≤a≤0.5--;
line 15, please change "75<X<82" to --75≤X≤82--;
line 16, please change "7<Y<15" to --7≤Y≤15--;
line 17, please change "7<Z<17" to --7≤Z≤17--; and
line 18, please change "0.2<a<0.5" to --0.2≤a≤0.5--.

In Column 1, line 17, please change "Fe-BS-i" to --Fe-B-Si--;
line 21, please change "$10^{5}$°-$10^{6}$° C./sec.," to --$10^{5}$-$10^{6}$ °C/sec.,--; and
line 39, please change "Fe-BS-i" to --Fe-B-Si--.

In Column 2, line 41, please change "75<X<82" to --75≤X≤82--;
line 42, please change "7<Y<15" to --7≤Y≤15--;
line 43, please change "7<Z<17" to --7≤Z≤17--;
line 44, please change "0.2<a<0.5" to --0.2≤a<0.5--;
line 57, please change "75<X<82" to --75≤X≤82--;
line 58, please change "7<Y<15" to --7≤Y≤15--;
line 59, please change "7<Z<17" to --7≤Z≤17--; and
line 60, please change "0.2<a<0.5" to --0.2≤a<0.5--.

UNITED STATES PATENT AND TRADEMARK OFFICE

CERTIFICATE OF CORRECTION

PATENT NO. : 5,522,947

DATED : June 4, 1996

INVENTOR(S) : Fumio Kogiku, Masao Yukumoto and Seiji Okabe

It is certified that error appears in the above-indentified patent and that said Letters Patent is hereby corrected as shown below:

In Column 4, line 7, please change "a is" to --a is--.

In Column 9, line 5, please change "75<X<82" to --75≤X≤82--; and
line 6, please change "7<Y<15" to --7≤Y≤15--.

In Column 10, line 1, please change "7<Z<17" to --7≤Z≤17--; and
line 2, please change "0.2<a<0.5" to --0.2≤a<0.5--.

Signed and Sealed this

Thirteenth Day of August, 1996

Attest:

Bruce Lehman

BRUCE LEHMAN

Attesting Officer

Commissioner of Patents and Trademarks